US006328580B2

(12) United States Patent
Hanning et al.

(10) Patent No.: US 6,328,580 B2
(45) Date of Patent: Dec. 11, 2001

(54) CONNECTING ELEMENT FOR CONNECTING CABLE SHIELDS

(75) Inventors: Walter Hanning, Detmold; Michael Schnatwinkel, Herford; Manfred Wilmes, Detmold, all of (DE)

(73) Assignee: Weidmüller Interface GmbH & Co., Detmold (DE)

( * ) Notice: Subject to any disclaimer, the term of this patent is extended or adjusted under 35 U.S.C. 154(b) by 0 days.

(21) Appl. No.: 09/733,945

(22) Filed: Dec. 12, 2000

(30) Foreign Application Priority Data

| | | |
|---|---|---|
| Dec. 16, 1999 | (DE) | 299 21 948 U |
| Apr. 18, 2000 | (DE) | 200 07 082 U |
| Aug. 29, 2000 | (DE) | 200 14 918 U |

(51) Int. Cl.[7] ..... H01R 4/66; H01R 13/648; H01R 4/48

(52) U.S. Cl. ..... 439/98; 439/817

(58) Field of Search ..... 439/98, 95, 101, 439/108, 729, 759, 816, 817, 821, 833, 716, 94, 819, 786

(56) References Cited

U.S. PATENT DOCUMENTS 5,735,700 4/1998 Hohorst .

FOREIGN PATENT DOCUMENTS

| | | |
|---|---|---|
| 94 10 214 | 9/1994 | (DE) . |
| 195 37 585 C1 | 2/1997 | (DE) . |
| 195 39 552 A1 | 4/1997 | (DE) . |
| 297 15 884 U1 | 12/1997 | (DE) . |
| 197 14 634 A1 | 10/1998 | (DE) . |
| 298 13 707 U1 | 11/1999 | (DE) . |

*Primary Examiner*—Brian Sircus
*Assistant Examiner*—Chandrika Prasad
(74) *Attorney, Agent, or Firm*—Laubscher & Laubscher

(57) ABSTRACT

An electrical connecting element includes a connector body containing an opening for receiving the exposed shield portions of a plurality of shielded cables, a pair of clamping devices being provided for resiliently biasing the shield portions of the cables into electrical contact with the connector body. Male plug contacts extend from the connector body for insertion into corresponding female contact openings carried by a module, terminal block or the like, thereby to connect the cable shield with circuitry contained within the component.

21 Claims, 3 Drawing Sheets

CONNECTING ELEMENT FOR CONNECTING CABLE SHIELDS

FIELD OF THE INVENTION

A conductive connecting element is disclosed for electrically connecting the shield of a shielded cable with an electronic module, terminal block or the like.

BACKGROUND OF THE INVENTION

Brief Description of the Prior Art

In the German patent No. DE 195 37 585 C1, a cable shield connection element is disclosed that includes a plug that is designed for insertion in the conductor connection of a polyethylene binding post. Upon the current conduction piece, there is furthermore retained and guided a clamp strap, and it is resiliently supported by means of a spring opposite an angled bridge of the current conduction piece. The clamp strap has a seat located below the down-angled bridge for the shielded cable, which is clamped firmly in the seat and under the bridge by the spring. The potential of the connected cable shield can thus be transmitted directly to the polyethylene connection of a terminal block.

While the known cable shield connection element has proved to be effective, it was found that for modules or terminal blocks with connections that are placed closely directly adjacent each other, it is desirable that the typical connection element be so further improved that uncomplicated connection and operation from two or more screening cables in a tight space will also be possible. The present invention was developed to solve this problem.

The present invention relates to a connection element for the connection of the shields of shielded cables to conductor connections of at least one module, including a plug connection for insertion in the conductor connection of the module, and a spring-actuated clamping device conductively connected with the plug connection for the purpose of mounting the shielded cable on the connection element, wherein the plug connection is made as a multiple plug connection that can be inserted in two or more conductor connections, arranged directly next to each other, of at least one module or at an interval from each other and where the clamping means serves to fasten a plurality of shielded cables upon the connection element.

In contrast to the typical state of the art, a separate connection element is not required for each shielded cable according to the invention; therefore, several shielded cables can be connected to the connection element in a tight space without having to accept the disadvantages of a separate bus bar that takes a relatively large space. Instead, several connections can be contacted directly with a preferably plug-like connection element. The invention therefore is particularly suitable for modules that are made as terminal-block-like, disc-shaped elements for latching upon a mounting rail and that by themselves or lined up have at least two directly adjacent conductor connections. Moreover, the invention is also suitable for module blocks or combination lineups of module-like elements, such as module discs or terminal blocks.

SUMMARY OF THE INVENTION

Accordingly, a primary object of the present invention is to provide a connector element for electrically connecting the exposed braided concentrically-wound shield layer of at least one of a plurality of shielded cables with at least one conductive fitting on a module or terminal block, characterized in that the connector body contains an opening for receiving the exposed shield portions of a plurality of cables, together with a plurality of clamping means for biasing the respective cables toward a conductive portion of the connector body, thereby to achieve an electrical connection between the shield of each cable and the connector. Plug terminals are provided on the connector body for insertion within corresponding female contacts carried by the terminal block, thereby to connect the cable shield with circuitry contained in the terminal block.

According to a more specific object of the invention, the cable clamping means includes a pair of clamping straps that are movably connected with the connector body for biasing a pair of cables to effect engagement of the exposed braided shield layers with a conductive portion of the opening that receives the cables. The connecting element preferably has a U-shaped cross-sectional configuration, the clamping straps being guided externally in longitudinal guide slots contained in the wing portions of the connector body, or side-by-side on the transverse wall of the connector body.

According to a another embodiment of the invention, the connector body is provided in the area of the slots with downward embossings or inward moldings that receive and guide projections on the clamping straps. The projections and the longitudinal sides of the contiguous straps as well as the longitudinal sides of the slots preferably have corresponding guide sliding surfaces. This means that the clamping straps do not at all protrude over the outside edges of the connector or do so only to a particularly small extent, something that reduces the width and thus the space requirement of the arrangement.

According to a further object of the invention, the insertion of the conductors is made in a simple manner. The clamping straps can be latched upon the frame for the purpose of inserting the screen cable. This is suitably accomplished, for example, by a projection behind widenings provided in the slot for the insertion of the clamping straps. In addition to the disc-like modules, the invention is also suitable for other kinds of modules, such as module blocks or for support-rail-mounted modules or terminal-block-like modules (for example, terminal blocks) and can also be designed for more than two directly adjacent conductor connections. The following might be conceivable, for instance: A kind of comb-like design, for example, for the purpose of connecting a cable shield to very specific, predesignated (for example, the first, the third, etc.) conductor connections of a module block resembling the function of a bus bar. The connection elements are particularly advantageous with a double plug connection, and two clamping straps are also suitable for module blocks with many conductor connections lying next to each other.

BRIEF DESCRIPTION OF THE DRAWINGS

Other objects and advantages of the invention will become apparent from a study of the following specification when viewed in the light of the accompanying drawings, in which.

DETAILED DESCRIPTION

Figure 1:
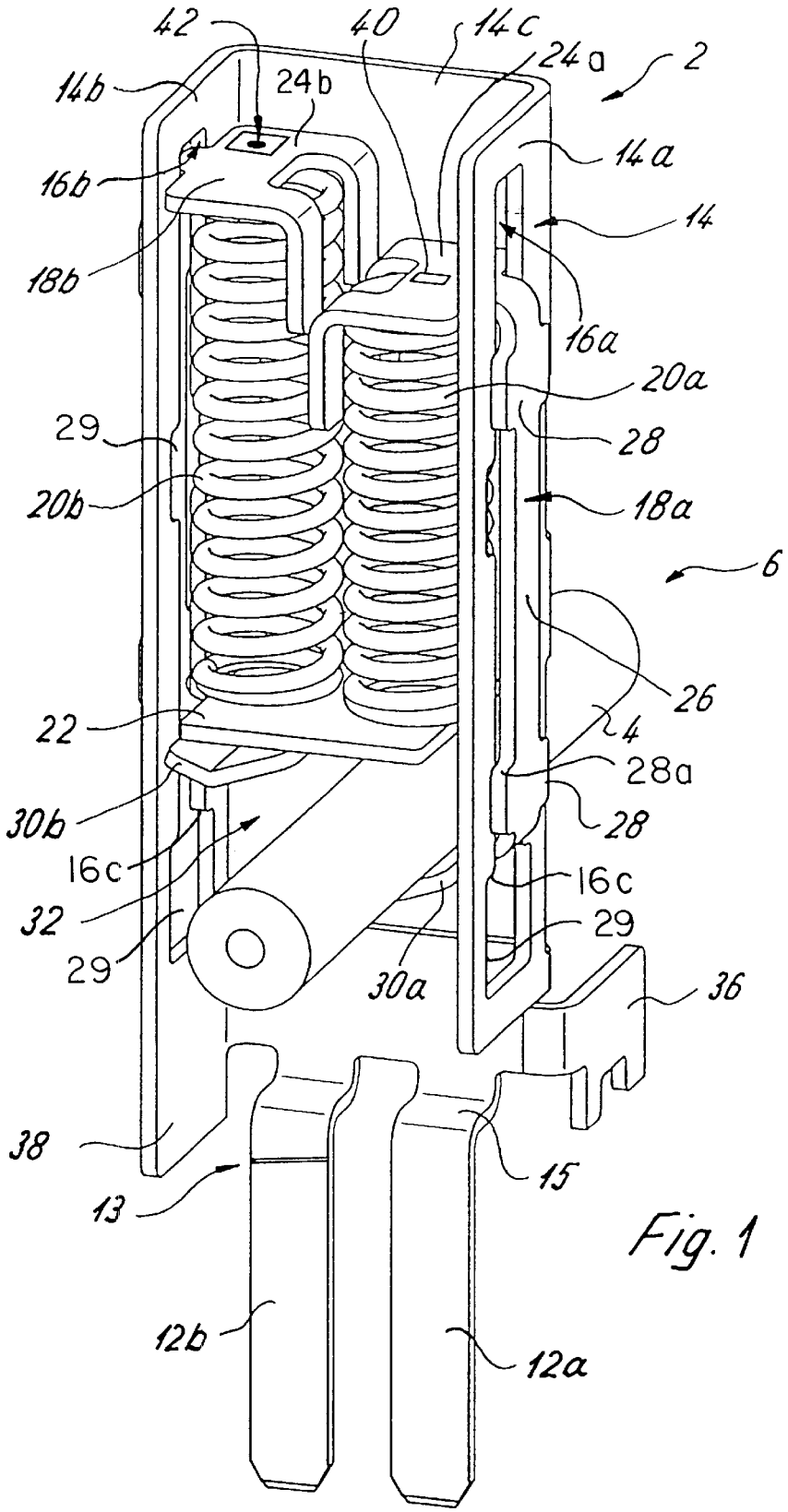
FIG. 1 is a front perspective view of a first connecting element according to the present invention.

Referring more particularly to FIG. 1, the connector element 2 of the present invention is operable to connect the exposed braided concentrically arranged shield layer 4 of a shielded cable 6 with conductor contacts 8*a* and 8*b* (FIG. 2) of an electronics module 10. The connector body is formed of a conductive material such as copper and includes a pair of downwardly extending flat male plug terminals 12*a* and 12*b* that are adapted to extend within corresponding female fittings 8*a* and 8*b*, respectively, on the module. The connector body 14 has a generally U-shaped cross-sectional configuration and includes a pair of parallel spaced wing portions 14*a*, 14*b* that are connected by a transverse wall 14*c*. The connector body wing portions 14*a* and 14*b* contain a pair of longitudinally-extending slots 16*a* and 16*b* that slidably receive a pair of clamping straps 18*a* and 18*b*, respectively. A pair of helical compression springs 20*a* and 20*b* are mounted at one end on a transverse bridge portion 22 that is partially punched from the transverse wall 14*c* of the connector body, and is bent orthogonally to a position between the wing portions 14*a* and 14*b* and the transverse wall portion 14*c*, thereby to define in the transverse wall 14*c* an opening 32 for receiving a plurality of the shielded cables 6. At their upper ends, the compression springs 20*a* and 20*b* react against spring seats 24*a* and 24*b* that are connected with the clamping straps 18*a* and 18*b* via the slots 16*a* and 16*b*, respectively. At their lower ends, the clamping straps are provided with cable seat portions 30*a* and 30*b* that are arranged between the wing portions 14*a* and 14*b* for supporting the exposed shield portions of a pair of shielded cables 6, respectively. The compression springs 20*a* and 20*b* normally bias the clamping straps 18*a* and 18*b* upwardly to displace the braided cable shield portion 4 of the cable 6 toward electrical engagement with the bridge portion 22 of the connector body 14. The connector body also includes an angularly arranged support tab 36 and support base 38 at the lower end of the connector body 14, thereby to support the connector body on the upper surface of the module 10 when the plug leads 12*a* and 12*b* are inserted within the conductor fittings 8*a* and 8*b*, respectively.

The clamping straps 18*a* and 18*b* are slidably mounted externally of the wing portions 14*a* and 14*b*, lateral projections 28 being provided at the upper and lower ends of the clamping straps for insertion within corresponding latching recesses 29, thereby to latch the straps in their lower-most released positions relative to the conductive bridge portion 22 of the connector body 14. A tool receiving notch 40 is provided in the upper surface of the spring seat portion 24*a* of the clamping strap 18*a*, and a recess 42 is provided in the upper surface of the spring seat 24*b* for receiving a suitable indicia-bearing label or the like. If desired, the male contacts 12*a* and 12*b* may be offset from the transverse wall 14*c* of the connector body by means of a stepped offset 15. Furthermore, the plug contacts may be provided with scored fold lines 13.

Figure 2:
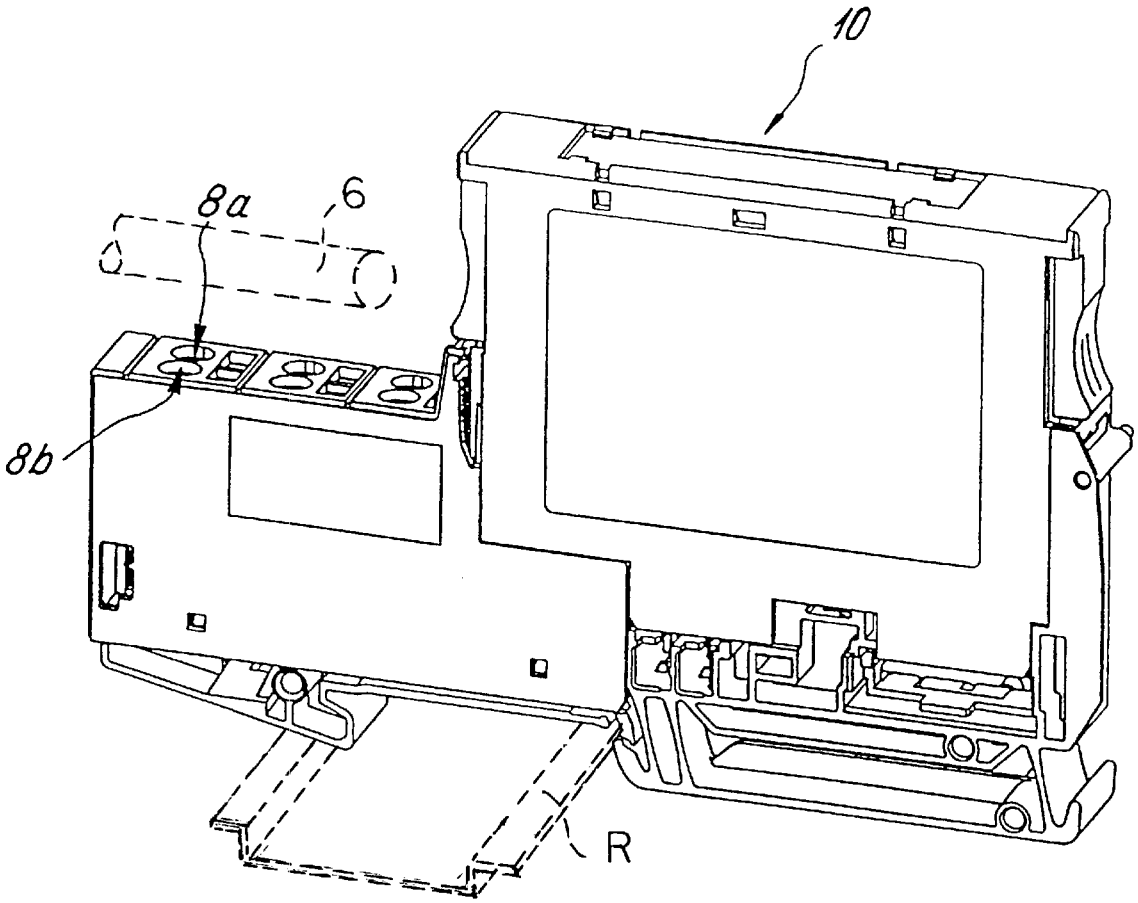
FIG. 2 is a perspective view of the electronic module to which the shield of the cable is to be electrically connected.

When the plug leads 12*a* and 12*b* are inserted within the female fittings 8*a* and 8*b* of the module 10, it will be apparent that the shielded cable 6 will have a horizontal coplanar orientation relative to the module 10, as illustrated in phantom in FIG. 2. Referring to the modification of FIG. 3, the male contacts 12*a*' and 12*b*' are bent at right angles to the connector body 14, whereupon the shielded cable 6 extends at right angles to the axis of the terminal block T which is mounted on the supporting rail R. Again, the braided shield layer 4 is electrically connected with the female fittings 8*a* and 8*b* by the male contacts 12*a*' and 12*b*', respectively.

Figure 4:
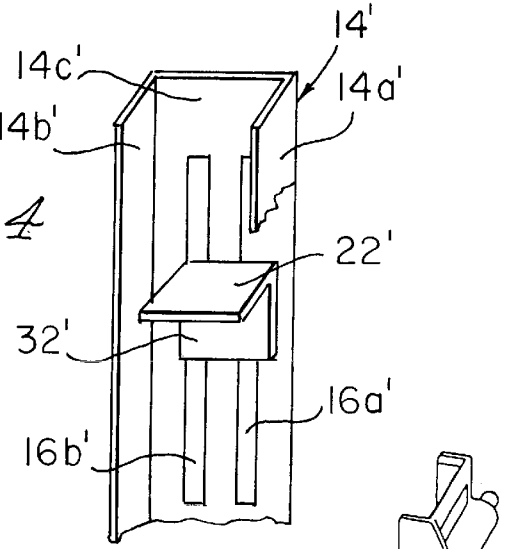
FIG. 4 is a detailed perspective view illustrating a modification of the connector body of FIG. 1.

Referring to the modification of FIG. 4, the vertical guide slots 16*a*', 16*b*' for the clamping straps may be provided if the transverse wall portion 14*c*' of the connector body 14'. As before, the supporting bridge portion 22' is partially punched and deformed from the transverse wall 14*c*', thereby to define the cable-receiving opening 32'.

The fold lines 13 in the flat male plugs are provided for selectively folding back those plugs that are not to be inserted within the corresponding fittings carried by the module or the terminal block. The cable seat portions 30*a* and 30*b* have a generally V-shaped cross-sectional configuration, thereby to support the associated cable 6.

In operation, in order to connect the braided shield layer 4 of a shielded cable 6 with a conductor contained within the module 10, or the terminal block T, a screw driver or other operating tool is inserted within the notch 40 and depressed to lower the mounting strap 18*a* downwardly toward the released position relative to the bridge portion 22, whereby the exposed braided shield portion of the cable may be introduced within the opening 32. Upon release of the insertion tool, the compression spring 20*a* expands to bias the clamping strap 18*a* upwardly, thereby to bias the braided screen portion 4 into electrical engagement with the lower surface of the bridge 22 of the conductive connector body 14. The male terminal projections 12*a* and 12*b* are then inserted within the corresponding fittings 8*a* and 8*b* contained in the module 10, thereby connecting the shield layer 4 with the conductive circuits contained within the module 10. It is important to note that the adjacent edges of the cable seat portions 30*a* and 30*b* are unobstructed, and are opened toward each other, thereby permitting the recess 32 to afford enough space for the movement of the shielded cable 6 that are generally provided with a rather bulky braided shield layer 4.

Thus, in the embodiment of FIG. 1, a simple and reasonably priced connecting element 2 is provided, which in a relatively tight space, facilitates the connection of a plurality of shielded cables 6 with an electronics module 10.

Figure 3:
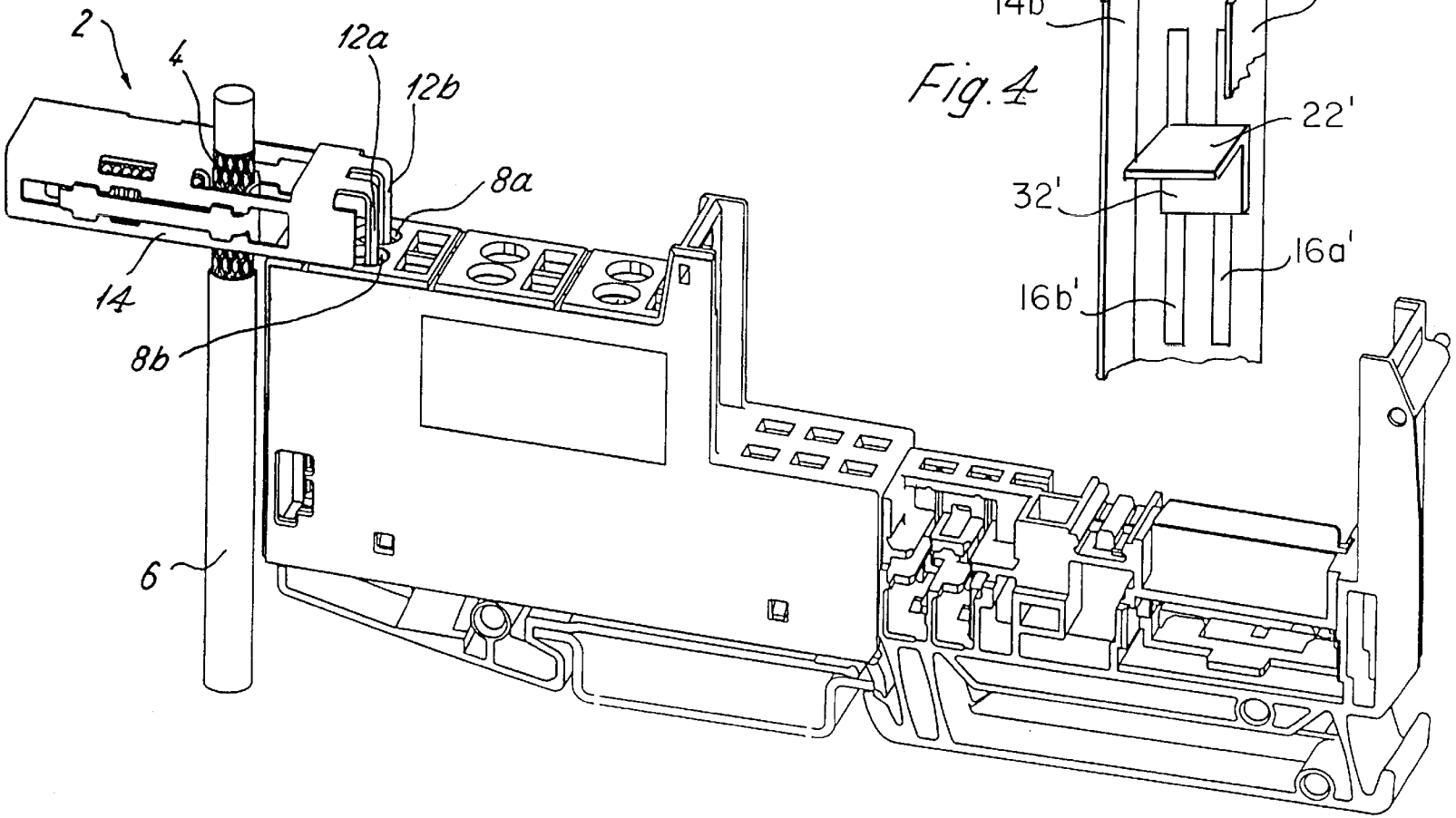
FIG. 3 illustrates a modification of the electrical connector of FIG. 1 for connecting the cable shield with a rail-mounted terminal block.

Similarly, in the embodiment of FIG. 3, the cable 6 is connected with the connector 14 and is oriented vertically relative to the horizontal supported rail R and the horizontal longitudinal axis of the terminal block T, owing to the orthogonal arrangement of the mail connecting terminals 12*a*' and 12*b*'.

While in accordance with the provisions of the Patent Statutes the preferred form and embodiment of the invention have been illustrated and described, it will be apparent to those skilled in the art that various changes may be made without deviating from the inventive concepts set forth above.

What is claimed is:

1. An electrical connecting element for electrically connecting the exposed electrical shields (4) of at least two cables (6) with a plurality of female conductor fittings (8*a*, 8*b*) on a module (10), comprising:

(a) a conductive connector (2) including:

(1) a conductive connector body (14) having a generally U-shaped cross sectional configuration including a pair of parallel spaced wing portions (14*a*, 14*b*), and a transverse portion connected between said wing portions; and (2) a plurality of male projections (12*a*, 12*b*) extending from said connector body opposite the female fittings, respectively; and (b) a pair of resilient clamping means (18*a*, 18*b*) for normally respectively clamping a pair of shielded cables with said connector body so that the exposed shield of each cable is in electrical contact with said connector, whereby when said male projections are introduced into the female conductor fittings, the cable shield of each cable is connected with the module via the connecting element.

2. A connecting element as defined in claim 1, wherein each of said clamping means includes an external clamping strap (18*a*, 18*b*) movably connected with said connector body for displacement between cable clamping and released positions relative to said connector body portion, and spring means (20*a*, 20*b*) biasing said clamping strap toward said clamping position.

3. A connecting element as defined in claim 2, and further including a module (10) adapted for mounting on a mounting rail (R), said module including a plurality of female conductor fittings (8*a*, 8*b*); and further wherein said connector element is connected in one of two orthogonally arranged orientations (FIG. 1; FIG. 3) relative to said module, said male projections extending within said female fittings, respectively.

4. A connecting element as defined in claim 2, wherein each of said clamping straps is connected for sliding displacement within a longitudinal slot (16*a*, 16*b*) contained in one of said connector body wing and transverse wall portions, respectively.

5. A connecting element as defined in claim 4, wherein each of said clamping straps includes lateral projections (28) that slidably engage the external surface of the associated connector body portion, respectively.

6. A connecting element as defined in claim 5, wherein said connector body includes a stationary bridge portion (22) that extends orthogonally between said connector body wing portions, and further wherein each of said clamping straps includes a cable seat portion (30*a*, 30*b*) that is arranged between said connector body wing portions and is connected with the clamping strap via the associated slot, said cable slot portion being operable to clamp an associated cable against said bridge when said strap is in said clamping position.

7. A connecting element as defined in claim 6, wherein the adjacent sides of said cable seat portions (30*a*, 30*b*) are adjacent and unobstructed.

8. A connecting element as defined in claim 7, wherein said connector element bridge portion (22) is partially punched from the transverse wall portion (14*c*) of said connector body, thereby to define a punched opening (32) for receiving the shielded cables.

9. A connecting element as defined in claim 4, wherein said slots are contained in said connector body wing portions, respectively.

10. A connecting element as defined in claim 4, wherein said slots are contained in said connector body transverse wall portion.

11. A connecting element as defined in claim 2, and further including latch means (28*a*; 16*c*) for latching said clamping straps in said released positions, respectively.

12. A connecting element as defined in claim 7, wherein each of said slots contains a widened opening (29) for the introduction of said cable seat portion into the space defined between said connector body wing portions.

13. A connecting element as defined in claim 6, wherein each of said clamping straps includes an orthogonal spring seat portion (24*a*, 24*b*) arranged in the space between said connector body wing portions, said spring seat portion being connected with said strap via the associated slot and further wherein said clamping means includes a compression spring (20*a*, 20*b*) arranged longitudinally between said bridge portion (22) and the associated spring seat portion (24*a*, 24*b*).

14. A connecting element as defined in claim 13, wherein said spring seat portion (24) contains a notch (40) for receiving the tip of a operating tool, thereby to permit displacement of said clamping strap toward said released position.

15. A connecting element as defined in claim 8, wherein said punched opening (32) is generally coplanar with said male projections (12*a*, 12*b*), whereby said cable will be supported directly opposite the module conductive fittings (8*a*, 8*b*).

16. A connecting element as defined in claim 8, wherein said male projections (12*a*, 12*b*) are integral with said connector body and comprise flattened insertion pin contacts.

17. A connecting element as defined in claim 6, wherein said insertion pin contacts extend at right angles to said connecting element body, whereby the shielded cable is clamped at a position offset from said module fittings (8*a*, 8*b*).

18. A connecting element as defined in claim 16, wherein said insertion pin contacts are coplanar with the transverse wall portion of said connector body.

19. A connecting element as defined in claim 3, and further wherein said connecting body includes support tabs (36, 38) for supporting said connecting element on said module when said male projections are connected with said module fittings.

20. A connecting element as defined in claim 13, wherein said spring seat portion contains a recess (42) for receiving an indicia-bearing member.

21. A connecting element as defined in claim 16, and further including offset means (15) for offsetting said flattened pin contacts relative to said connector body transverse wall.

* * * * *